US005899483A

United States Patent [19]

Paris

[11] Patent Number: 5,899,483

[45] Date of Patent: May 4, 1999

[54] DEVICE FOR RETAINING A BOOT ON A GLIDING BOARD, THE DEVICE INCLUDING A JOURNALLED DORSAL SUPPORT ELEMENT

[75] Inventor: Jean-Francois Paris, Sevrier, France

[73] Assignee: Salomon S.A., Metz-Tessy, France

[21] Appl. No.: 08/865,992

[22] Filed: May 30, 1997

[30] Foreign Application Priority Data

Jun. 4, 1996 [FR] France ..... 96 07029

[51] Int. Cl.[6] ..... A63C 9/16

[52] U.S. Cl. ..... 280/611; 280/11.36; 280/624; 280/626; 280/611

[58] Field of Search ..... 280/11.36, 14.2, 280/624, 625, 626, 631, 632

[56] References Cited

U.S. PATENT DOCUMENTS

| | | | |
|---|---|---|---|
| 3,964,759 | 6/1976 | Salomon | 280/626 |
| 4,168,084 | 9/1979 | Von Besser et al. | 280/626 |
| 4,846,492 | 7/1989 | Bataille . | |
| 5,261,689 | 11/1993 | Carpenter et al. | 280/14.2 |
| 5,577,757 | 11/1996 | Riepl et al. . | |
| 5,697,631 | 12/1997 | Ratzek et al. | 280/625 |
| 5,727,797 | 3/1998 | Bowles | 280/14.2 |

FOREIGN PATENT DOCUMENTS

| | | |
|---|---|---|
| 680775 | 11/1995 | European Pat. Off. . |
| 705625 | 4/1996 | European Pat. Off. . |
| 4311630 | 8/1994 | Germany . |
| 95/33534 | 12/1995 | WIPO . |

*Primary Examiner*—Charles T. Jordan
*Assistant Examiner*—Charles R. Drucker, Jr.
*Attorney, Agent, or Firm*—Greenblum & Bernstein, P.L.C.

[57] ABSTRACT

A device for retaining a boot on a gliding board. The device includes in particular a dorsal support element and a base, the dorsal support element being journalled on the base along a substantially transverse Y-Y' axis of the device, wherein at least one control device generates a journal movement of the dorsal support element with respect to the base along the Y-Y' axis, from an opening position toward a closing position in a rear-to-front direction, when the sole of the boot is displaced toward the board during affixation of the boot, wherein an elastic element biases the dorsal support element along the Y-Y' axis in a front-to-rear direction, wherein a stop limits the movement of the dorsal support element in the front-to-rear direction, and wherein the dorsal support element has a scallop at the level of the heel of the boot.

11 Claims, 4 Drawing Sheets

II 7
7
2
5
4
26
25
III
III
16
22
24
11
10
9
6
20
S
18
1
14
R
3
8
21
II 7
2
5
4
26
24
25
9
1
10
6
S
18
R
3
8
27

DEVICE FOR RETAINING A BOOT ON A GLIDING BOARD, THE DEVICE INCLUDING A JOURNALLED DORSAL SUPPORT ELEMENT

BACKGROUND OF THE INVENTION

1. Field of the Invention

The present invention relates to the field of devices for retaining a boot on a gliding board adapted for snowboarding. The invention relates more particularly to boot retention device which includes a rear support element for the lower part of the leg.

2. Background and Material Information

In snowboarding, a user is led to affix and remove the boots several times, for example when using various means of mechanical lifts, or after a fall. Therefore, it is important that each device for retaining a boot on the board enable the boots to be affixed and removed quickly and easily. Of course, affixation of the boot must be considered as the operation which consists of affixing the boot to the board, removal of the boot being the reverse operation.

The prior art has proposed numerous retention devices which enable quick and easy affixation and removal of the boot. Such devices were initially used with boots having a relatively rigid upper and made, for example, with shells made of a plastic material. Generally, these devices include means for affixing the boot to the board which acts substantially at the level of the sole, the upper being used for maintaining the foot and passing sensorial information at the level of the foot and of the lower part of the leg. The boot is generally affixed either by hand, or by using the foot alone, which, in this case, saves the user from having to bend down to use his hands.

A recent change in the equipment consists of associating retention devices for quick use with boots having a relatively flexible upper, so that the user can make sufficiently ample leg movements to operate the board. In this case, a support element for the lower part of the leg is associated with the device such that the user can easily take support on the snow with the rear running edge of his board.

However, it has appeared that these devices are not really satisfactory. Indeed, the support element for the lower part of the leg has a generally curved and ergonomical shape which follows the profile of the leg when the user is in an orthostatic position.

It follows that the user is hindered by the support element when affixing or removing the boot, thus loosing the advantage provided by a retention device for quick use.

Furthermore, the presence of the support element forces the user to displace and incline the foot forwardly, with respect to the support element, to put on the boot, which prevents a correct positioning of the boot with respect to the retention device.

SUMMARY OF THE INVENTION

In order to remedy these disadvantages, the invention proposes a device for retaining a boot on a gliding board, the device including in particular a dorsal support element to ensure the rear support of the lower part of the leg and a base adapted to receive, at least partially, the sole of the boot, the dorsal support element being journalled on the base along a substantially transverse Y-Y' axis of the device.

According to the invention, at least one control device generates a journal movement of the dorsal support element with respect to the base along the Y-Y' axis, from an opening position toward a closing position in a rear-to-front direction, when the sole is displaced toward the board during affixation of the boot.

This structure enables the user to bring the support element substantially into contact with the lower part of the leg by using the foot alone at the time the boot is affixed.

It only takes a preliminary leg movement to move the support element away in order for the affixation of the boot to be easy and precise. Therefore, the support element does no longer constitute a hindrance at the time the boot is affixed.

Preferably, according to the invention, an elastic device biases the dorsal support element with respect to the base along the Y-Y' axis, according to a journal movement in a front-to-rear direction.

It follows that the dorsal support element is naturally moved away from the trajectory of the boot at the time the boot is put on, thereby rendering the affixation of the boot even faster.

Further, according to the invention, a stop limits the journal movement of the dorsal support element with respect to the base along the Y-Y' axis, in the front-to-rear direction.

Therefore, a low amplitude movement of the boot suffices to bring the dorsal support element into a usage position after the boot is affixed, which has the advantage of further facilitating the affixation of the boot.

Preferably, according to the invention, the dorsal support element has a scallop in the area of the heel of the boot.

This structure enables the user to transmit specific forces to the retention device, especially for rear edge setting. Indeed, the support occurs in the area of the lower part of the leg, providing the user with more power and precision in operating the board. An additional advantage is that the scallop facilitates the passage of the heel of the boot at the time of the boot is affixed.

According to a first embodiment, the control device is a pin affixed to the boot, the pin cooperating with an arm of the dorsal support element to create a lever effect with respect to the Y-Y' axis. The displacement of the dorsal support element is advantaeously correlated to the displacement of the boot at the time it is affixed.

Preferably, the pin of the boot cooperates with a guide affixed to the base, the guide being a cavity that is demarcated, at least partially, by a surface for positioning the pin. This structure has the advantage of being simple and easy to make. In addition, it makes it possible to bring the dorsal support element into a precise position after the boot is affixed.

Still preferably, the device according to this first embodiment includes a latching device which is capable of cooperating with the pin, such that the pin is simultaneously substantially in contact with the positioning surface of the cavity and with the arm of the dorsal support element. The latching device includes a hook that is journalled on the base against the action of an elastic device.

This structure enables a simultaneous latching of the heel of the boot and of the dorsal support element. In addition, the latching is done automatically after the pin has reached the positioning surface. The advantage is that the steering forces transmitted to the dorsal support element are entirely absorbed by the retention device.

According to a second embodiment, the control device is a bar affixed to the dorsal support element. This structure advantageously makes it possible to use conventional boots.

Still according to the second embodiment, the bar connects two arms of the dorsal support element, the bar being capable of cooperating with the sole of the boot to create a lever effect with respect to the Y-Y' axis. This structure is such that the steering forces transmitted to the dorsal support element are entirely absorbed by the sole of the boot, the sole being itself affixed to the base by any known means. The advantage is that this construction is very simple and inexpensive to make.

BRIEF DESCRIPTION OF DRAWINGS

Other characteristics and advantages of the invention will be better understood along the following description, with reference to the annexed drawings illustrating, by way of non-limiting examples, how the invention can be embodied, and in which.

DETAILED DESCRIPTION OF THE PREFERRED EMBODIMENTS

Figure 1:
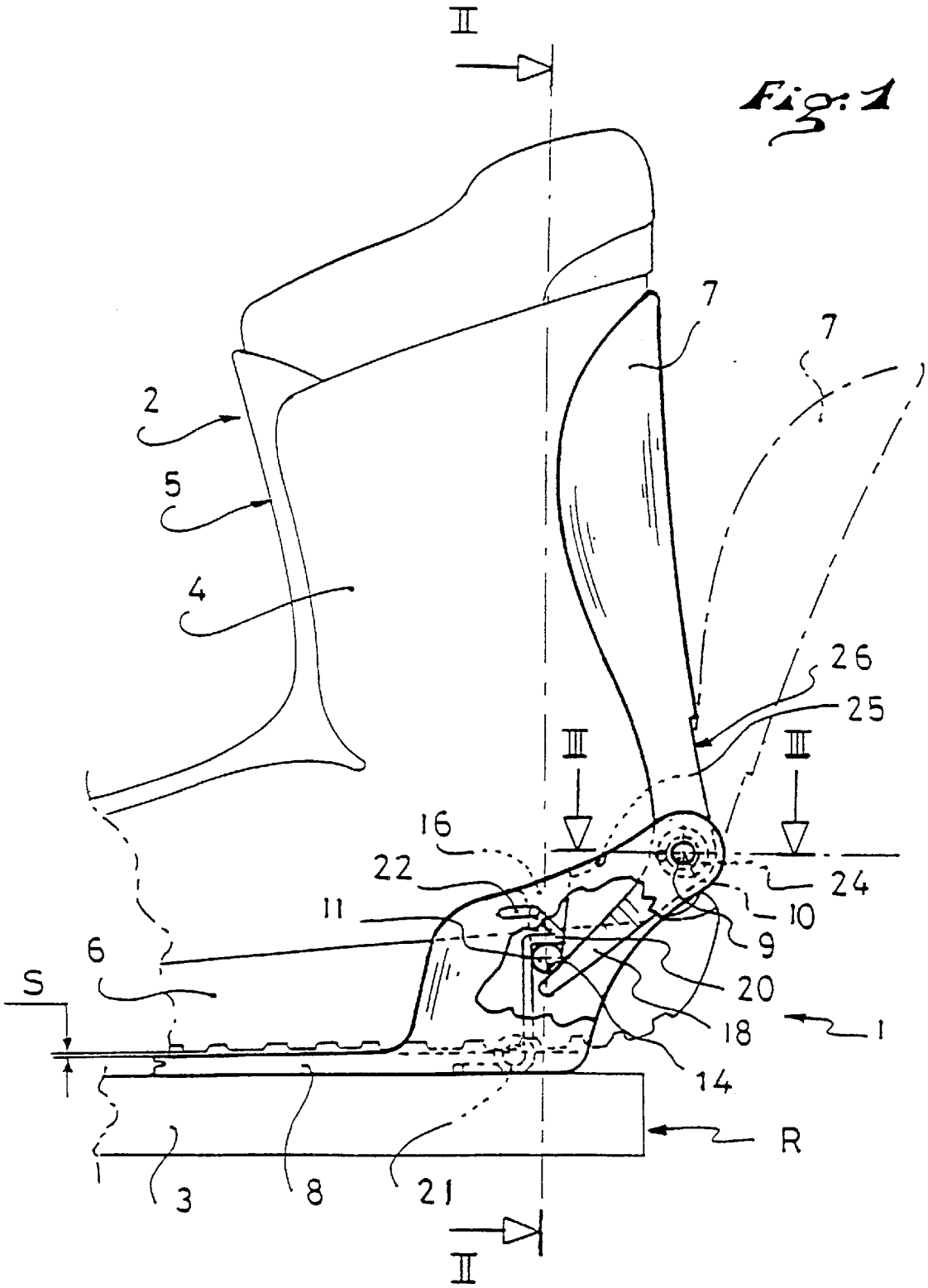
FIG. 1 is an external lateral view of a first embodiment of the device according to the invention.

FIG. 1 is a partial view of a device 1 for retaining a boot 2 on a gliding board 3, according to a first embodiment.

Only the rear portion 4 of the boot 2 is shown, because this is the portion that cooperates with the device 1 in the vicinity of a rear side R of the board 3.

The boot 2 includes an upper 5 affixed to a sole 6 by any known means, the upper 5 taking support on a dorsal support element 7 of the device 1, whereas the sole 5 is positioned on a base 8 of the device 1.

The dorsal support element 7 and the base 8 are linked to one another by a journal, which is shown here in the form of a rivet 9 having an axis 10, the axis 10 being oriented substantially in a transverse direction of the boot 2 and of the device 1.

Figure 2:
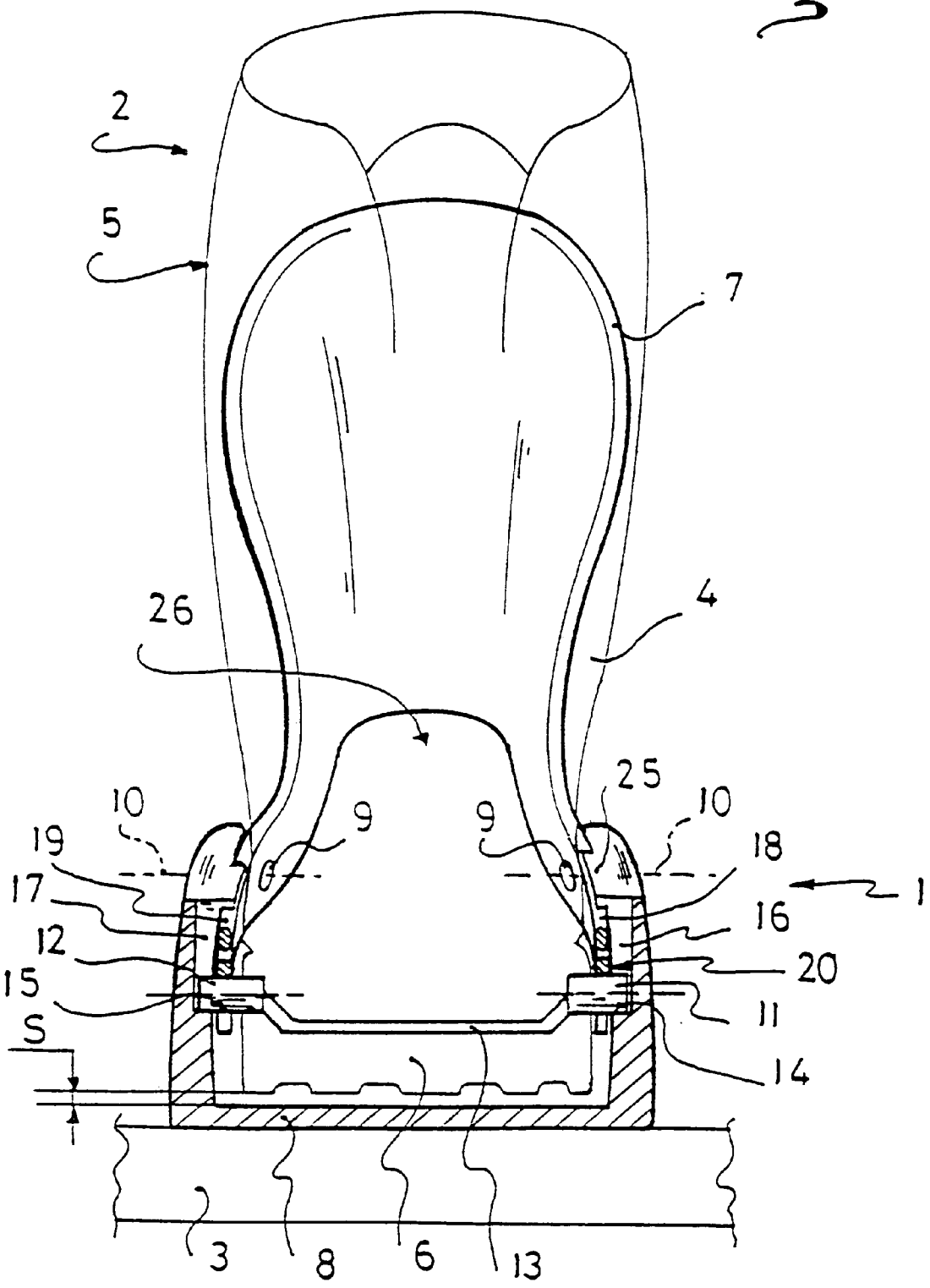
FIG. 2 is a cross-section along the line II—II of FIG. 1 showing from the front a boot cooperating with the device.

Preferably, as shown in FIG. 2, the journal of the dorsal support element 7, with respect to the base 8, includes two rivets 9 each having an axis 10, one of the rivets 9 being located on one side of the device 1, while the other is located on the opposite side, with respect to a longitudinal direction of the boot 2 and of the device 1. The longitudinal direction must be understood as being substantially parallel to the length of a foot, i.e., oriented from the toes toward the heel, or vice versa.

The longitudinal direction of the device 1 is substantially perpendicular to the axes 10 of the rivets 9, so as to enable a journal movement of the dorsal support element 7 with respect to the base 8, in a front-to-rear direction or in a rear-to-front direction. The front-to-rear direction corresponds to an extension of the foot with respect to the leg, the rear-to-front direction corresponding to a reverse movement obtained, for example, when a user bends the legs.

FIG. 2 also shows two lateral pins 11, 12, which are integral parts of the boot 2. The pins 11, 12, are, for example, cylinders that are connected to one another by a bar 13, the pins 11, 12, and the bar 13 forming a block that can be made of a metal such as steel, the block being preferably embedded in the sole 6 during manufacture.

For a better comprehension of the invention, the boot 2 is shown in a symbolic manner, as a transparent object, with the exception of the pins 11, 12 and of the bar 13.

The pins 11, 12, are respectively in support on the positioning surfaces 14, 15 located in open cavities 16, 17 of the base 8. The pins 11, 12, are in contact with the surfaces 14, 15, because the boot 2 is in a position for using the device 1. It is noted that in this case, there is a space S between the sole 6 and the base 8. This space enables the boot 2 to cooperate with the device 1 in all cases, even in the presence of foreign bodies, such as snow or ice.

The pins 11, 12, simultaneously fulfill several functions: they position the boot 2 with resect to the base 8 at the same time as they press on the arms 18, 19, respectively, of the dorsal support element 7.

Figure 4:
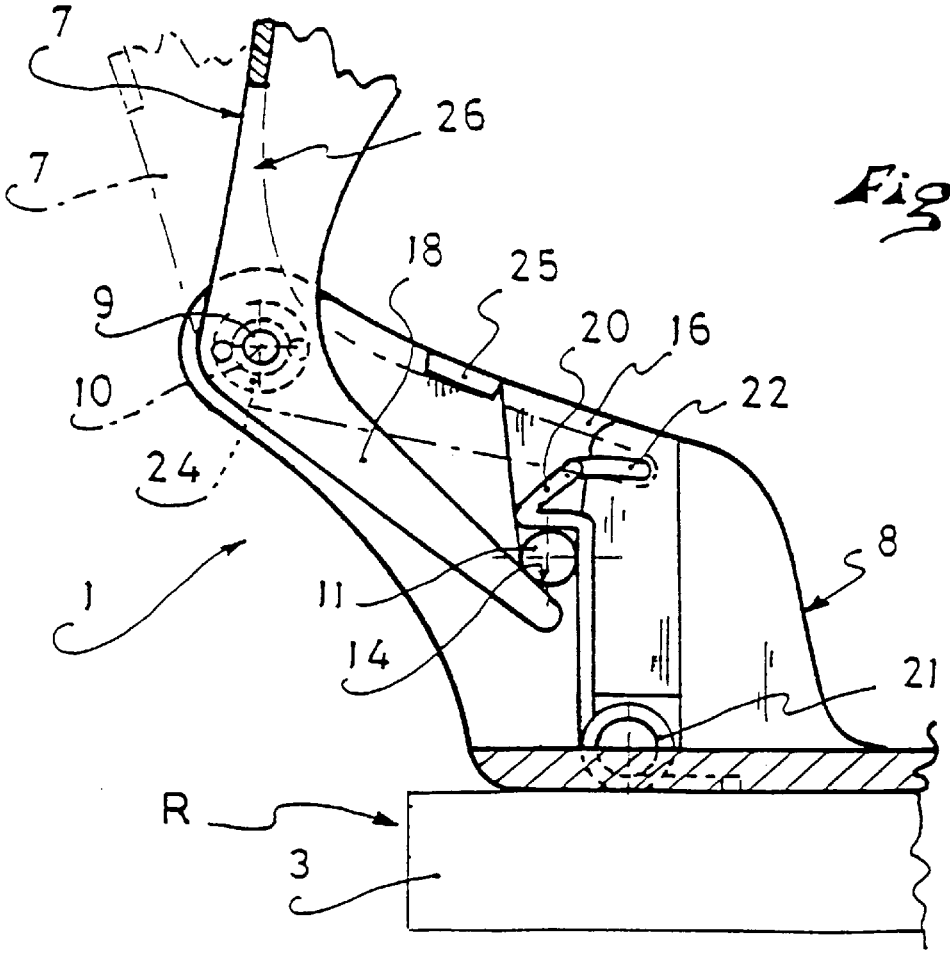
FIG. 4 is a partial cross-section along the line IV—IV of FIG. 3 showing details of the device in an internal vertical view.

FIG. 4 shows, from the inside of the device 1, the pin 11 both in position on the positioning surface 14 of the cavity 16 and in support on the arm 18 of the dorsal support element 7. For convenience, the boot 2 is not shown.

FIG. 4 also shows a latching device latching the pin 11 in the cavity 16 against the action of an elastic element or device. The latching device is represented by a hook-shaped end 20 of a wire, such as a steel wire.

The elastic element is represented by the other spring-shape end 21 of the same wire as that forming the hook 20. Therefore, the hook 20 serves to both maintain the pin 11 in a fixed position with respect to the base 8 and to prevent a rotation of the dorsal support element 7 with respect to the base 8 in a front-to-rear direction. The dorsal support element 7 is maintained in a closing position, represented by a solid line, by the hook 20.

Another hook and another spring act in a similar manner for the pin 12 in the cavity 17 and for the arm 19 of the dorsal support element 7.

Thus, when the user gives impulses toward the rear with the lower part of the leg, it is the entire device 1 that tends to accompany the boot 2, therefore enabling the user to take proper supports on the rear side R of the board 3.

The pins 11, 12, of the boot 2 are positioned in the cavities 16, 17, when the user brings the foot closer to the device 1. The shape of the hook 20 enables the pin 11 to move the hook 20 away, against the action of the spring 21, at the time the boot is affixed.

The same process takes place for the pin 12 and the associated hook.

The shape of each hook prevents each pin 11, 12, to then leave the cavity in which it is maintained.

If the user wants to release the rear portion of the boot 2 from the device 1, he can act on the hooks.

Figure 3:
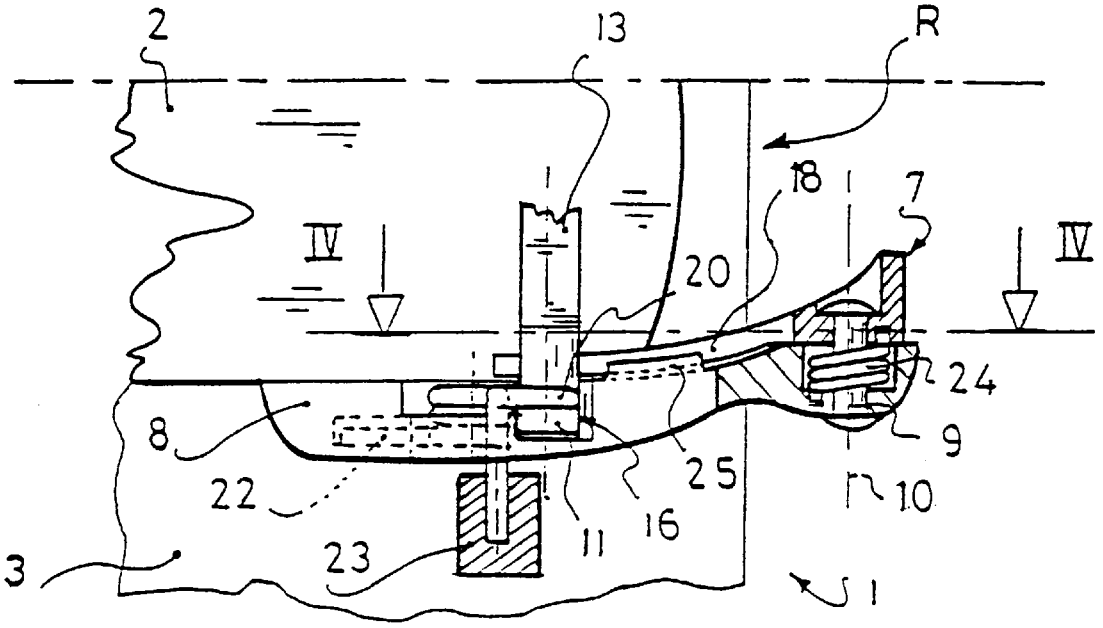
FIG. 3 is a partial cross-section along the line III—III of FIG. 1 showing details of the device in a top view.

FIG. 3 shows, in a cross-section, an example of a device that makes it possible to unlatch a pin.

For convenience, only one half of the device 1 is shown. This half corresponds to the side of the boot 2 carrying the pin 11, but a similar structure exists on the side of the boot carrying the pin 12.

FIG. 3 shows that the wire, which constitutes both the spring 21 and the hook 20, is extended on the side of the hook 20 by passing through a slit 22 of the base 8 to get housed in a finger 23.

The finger 23 is located outside of the device 1 and enables the user to displace the end of the wire in the slit 22. It follows that the hook 20 can be displaced in a direction of unlatching against the action of the spring 21.

When each hook has released the pin with which it is associated, the user can lift the rear portion of the boot 2 to remove it. Of course, the user can also be led to separate any other portion of the boot 2 which would be maintained on the base 8 by any means known to the one skilled in the art.

When the pins 11, 12, are no longer in place on the device 1, the boot 2 is no longer in contact with the base 8, and the dorsal support element 7 is no longer in contact with the upper 5 at the level of the lower part of the user's leg.

In this case, as shown in dotted lines in FIG. 4, for example, the dorsal support element 7 is placed in an opening position due to the actions of an elastic device and of a stop. The elastic element is shown in the form of a coil spring 24 wound about a rivet 9, an end of the spring 24 being affixed to the base 8 and the other end of the spring 24 being affixed to the dorsal support element by any known means, such as passage in an opening. The spring 24 biases the dorsal support element 7 in a front-to-rear direction of rotation with respect to the base 8. The stop which limits the displacement of the dorsal support element 7 is shown in the form of a projecting portion of the base 8, or abutment 25.

The spring 24 and the abutment 25 enable the dorsal support element 7 to be sufficiently spaced from the trajectory followed by the boot 2 when it is affixed, in order not to hinder the affixation of the boot. As the device 1 is provided to be used preferably with any other means for remaining another portion of the boot 2, which enables the retention by the action of the foot alone, the device offers the double advantage of the affixation of the boot being easy and precise. Of course, the operation of removing the boot is also facilitated by the release of the dorsal support element 7.

FIG. 1 also shows, in dotted lines, the opening position occupied by the dorsal support element 7 after removal of the boot. To further facilitate the movement of the boot 2 with respect to the device, a scallop 26 is provided in the dorsal support element 7.

As shown in FIG. 2, the scallop 26 is, for the most part, demarcated by the arms 18, 19, of the dorsal support element 7, such that the heel of the boot 2 passes freely. In fact, the dorsal support element 7 comes into contact with the upper 5 only at the level of the lower part of the user's leg. In this way, passage of sensational information is done in a manner that is more perceptible by the user.

Figure 5:
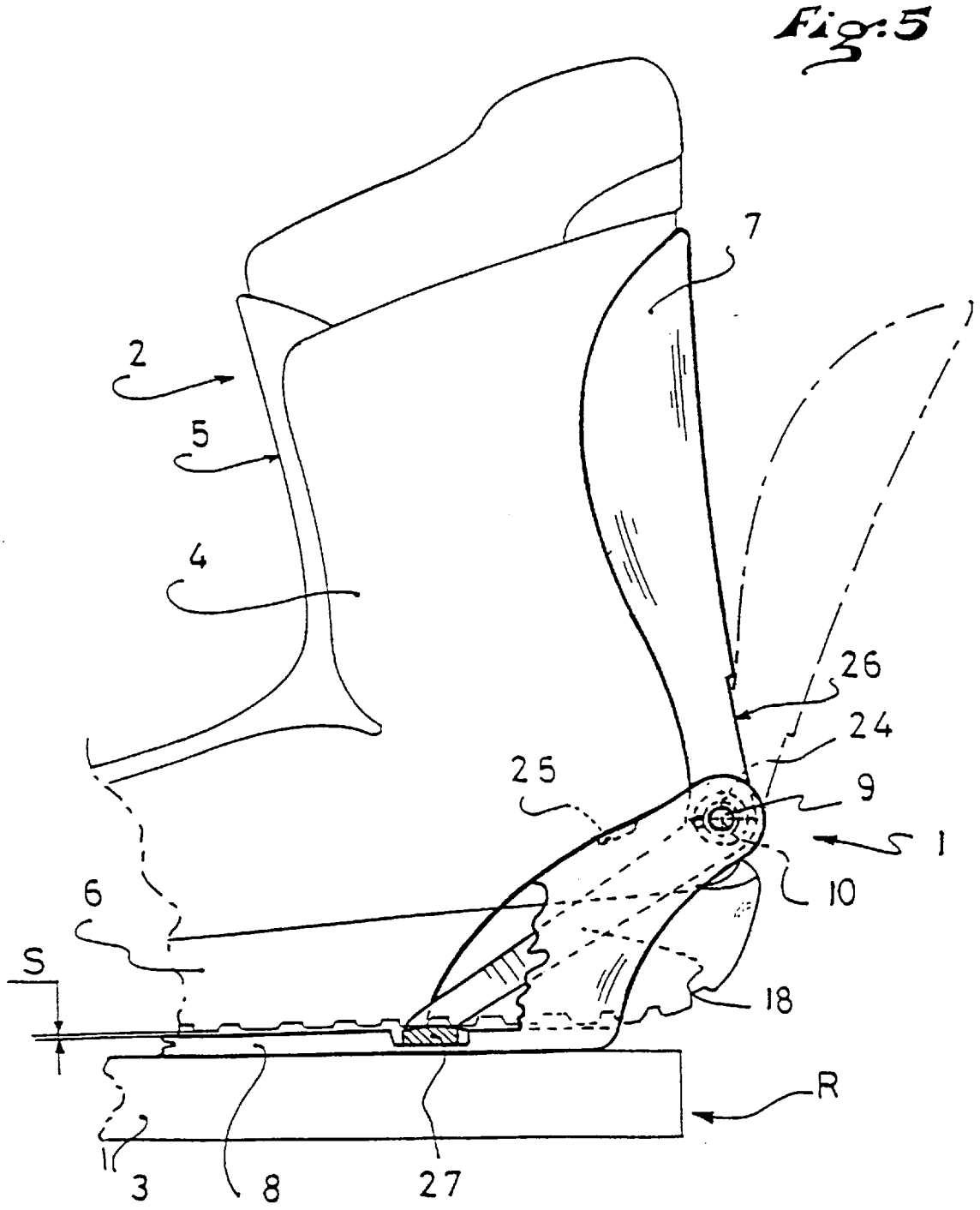
FIG. 5 is an external lateral view of a second embodiment of the device according to the invention.

It is possible to manage a movement of the dorsal support element 7 with respect to the base 8 with other embodiments, such as that shown in FIG. 5.

For convenience, the same elements are designated by the same numeral references.

This second example of embodiment distinguishes over the previous one by the following differences:

the boot 2 does not include any pins;

the base 8 does not include means for positioning and latching pins;

the arms 18, 19, each located on one side of the device 1 are connected to one another at their respective ends by a beam 27.

The other portions of the device 1 are similar to those of the first embodiment.

According to the second embodiment, when the user undertakes the affixation of the boot 2 in the device 1, the sole 6 pushes the beam 27 toward the board 3 against the action of the spring 24. After the boot is affixed, the sole 6 maintains the beam 27 against the portion of the base 8 located on the gliding board 3.

Preferably, the elements are sized such that a space S remains between the sole 6 and the base 8 for the same reasons as in the preceding case.

Also after the boot is affixed, the dorsal support element 7 is in contact with the upper 5 at the level of the lower part of the user's leg.

At the time the boot is removed, the sole 6 is moved away from the base 8, and the spring 24 in turn allows for a spacing of the dorsal support element 7 from the upper 5. Again, the abutment 25 limits the amplitude of the displacement of the dorsal support element 7.

In a second embodiment, the sole 6 must be maintained pressed on the beam 27 by any known means not shown in the figures, such as a heel automatic latching system.

Regardless of the embodiment, the materials used are conventional. In particular, the base 8 and the dorsal support element 7 can be made out of reinforced or non-reinforced plastic materials, or of metallic alloy.

Of course, the invention is not limited to the embodiments thus described, and includes all of the technical equivalents within the scope of the claims that follow.

In particular, one can provide to insert a spacer between the base 8 and the board 3, the spacer being capable of having means for adjusting its position with respect to the board 3.

One can also provide a device for simultaneous latching and unlatching of the pins 11, 12, in the case of the first embodiment.

The instant application is based upon the French Priority Patent Application No. 96 07029, filed on Jun. 4, 1996, the disclosure of which is hereby expressly incorporated by reference thereto, and the priority of which is hereby claimed under 35 U.S. C. §119.

What is claimed is:

1. A device for retaining a boot on a gliding board, the device comprising:

a dorsal support element to ensure the rear support of the lower part of the leg and a base adapted to receive, at least partially, a sole of the boot, the dorsal support element being journalled on the base along a substantially transverse Y-Y' axis of the device, wherein at least one control device generates a journal movement of the dorsal support element with respect to the base along the Y-Y' axis, from an opening position toward a closing position in a rear-to-front direction, when the sole is displaced toward the board during affixation of the boot.

2. A device according to claim 1, wherein an elastic device biases the dorsal support element with respect to the base along the Y-Y' axis, according to a journal movement in a front-to-rear direction.

3. A device according to claim 1, wherein a stop limits the journal movement of the dorsal support element with respect to the base along the Y-Y' axis, in the front-to-rear direction.

4. A device according to claim 1, wherein the dorsal support element has a scallop at the level of the heel of the boot.

5. A device according to claim 1, wherein the control device is a pin affixed to the boot, the pin cooperating with an arm of the dorsal support element to create a lever effect with respect to the Y-Y' axis.

6. A device according to claim 5, wherein a finger of the boot cooperates with a guide affixed to the base.

7. A device according to claim 6, wherein the guide is a cavity demarcated, at least partially, by a surface for positioning the finger.

8. Device according to claim 5, wherein a latching device is capable of cooperating with the pin, such that the pin is simultaneously substantially in contact with a positioning surface of a cavity and with the arm of the dorsal support element.

9. A device according to claim 8, wherein the latching device includes a hook that is journalled on the base against the action of an elastic element.

10. A device according to claim 1, wherein the control device comprises a beam affixed to the dorsal support element.

11. A device according to claim 10, wherein the beam connects two arms of the dorsal support element, the beam being capable of cooperating with the sole of the boot to create a lever effect with respect to the Y-Y' axis.

* * * * *